US011587543B2

(12) United States Patent
Perkmann et al.

(10) Patent No.: US 11,587,543 B2
(45) Date of Patent: Feb. 21, 2023

(54) CALIBRATION OF ACTIVE NOISE-CANCELLING HEADPHONES

(71) Applicant: AUSTRIAN AUDIO GMBH, Vienna (AT)

(72) Inventors: Michael Perkmann, Vienna (AT); Daniel Wöhrer, Vienna (AT); Ludwig Kollenz, Vienna (AT)

(73) Assignee: AUSTRIAN AUDIO GMBH, Vienna (AT)

( * ) Notice: Subject to any disclaimer, the term of this patent is extended or adjusted under 35 U.S.C. 154(b) by 0 days.

(21) Appl. No.: 17/454,782

(22) Filed: Nov. 12, 2021

(65) Prior Publication Data

US 2022/0157289 A1 May 19, 2022

(30) Foreign Application Priority Data

Nov. 13, 2020 (EP) ..... 20207549

(51) Int. Cl.
*H04R 1/10* (2006.01)
*G10K 11/178* (2006.01)

(52) U.S. Cl.
CPC ..... *G10K 11/17853* (2018.01); *H04R 1/1083* (2013.01); *H04R 2460/01* (2013.01)

(58) Field of Classification Search
CPC ..... G10K 11/17853; G10K 2210/1081; G10K 2210/3055; G10K 2210/504; G10K 11/17815; G10K 11/17817; G10K 11/17854; H04R 1/1083; H04R 2460/01; H04R 29/00; H04R 2410/05
USPC ..... 381/71.6
See application file for complete search history.

(56) References Cited

U.S. PATENT DOCUMENTS

| | | | | |
|---|---|---|---|---|
| 9,779,714 | B2 | 10/2017 | Theiler | |
| 2011/0222696 | A1 | 9/2011 | Balachandran | |
| 2019/0058952 | A1* | 2/2019 | Nawfal | H04R 5/04 |
| 2019/0080682 | A1* | 3/2019 | Darlington | H04R 1/1083 |

FOREIGN PATENT DOCUMENTS

| | | | |
|---|---|---|---|
| CN | 111800694 | A | 10/2020 |

* cited by examiner

*Primary Examiner* — Vivian C Chin
*Assistant Examiner* — Friedrich Fahnert
(74) *Attorney, Agent, or Firm* — Raven Patents, LLC; Anton E. Skaugset

(57) ABSTRACT

Methods for calibrating active noise-cancelling headphones, including placing the active noise-cancelling headphones on a measuring device; exciting the active noise-cancelling filter; measuring one or more relevant transmission pathways selected from x(n), m(n), and p(n) for feedforward and/or h(n) for feedback; defining at least one goal function for feedforward or feedback; calculating a complementary function for the defined goal function for at least one branch of the active noise-cancelling filter; calculating an impulse response of the complementary function from the measurements of the relevant transmission pathways; approximating operating parameters for the active noise-cancelling filter using the Prony method; and implementing the approximated operating parameters in the active noise-cancelling filter on the signal processor in order to create an approximated complementary active noise-cancelling filter, thereby calibrating the active noise-cancelling headphones.

10 Claims, 7 Drawing Sheets

CALIBRATION OF ACTIVE NOISE-CANCELLING HEADPHONES

TECHNICAL FIELD

The present disclosure relates to headphones capable of active noise cancellation, and more particularly to the calibration of active noise cancellation headphones.

BACKGROUND

Headphones that are capable of performing an active noise control or active noise cancellation (ANC) typically incorporate a microphone at or inside the headphone in order to provide a microphone signal reflecting environmental noise that is audible within the headphone. The active noise control circuit (and filter) may then be configured to evaluate the acoustic signal from the microphone, generate a corresponding correction signal, and transmit the correction signal to the speakers of the headphone as a way of minimizing the audibility or effect of the environmental noise. In an ideal situation, the corresponding correction signal is an ideal match to the environmental noise, but 180 degrees out of phase, resulting in the environmental noise and the correction signal effectively cancelling each other out when superimposed.

In reality, the microphones, speakers, electronics and acoustic insulation of ANC headphones all contribute to the passive attenuation characteristics of the resulting headphone, resulting in individual variability. As a result, the noise control ability of ANC headphones could be improved by individually adjusting the electronics of each headphone during manufacture of the headphone. In particular, gain adjustment of the sensing microphones' amplification stages may be required in order to achieve a desired level of noise reduction.

U.S. Pat. No. 9,779,714 (hereby incorporated by reference), which corresponds to international publication no. WO 2010/049241 A1, discloses a process of ANC headphone calibration that includes placing the headphone on an artificial head that incorporates microphones including a filter (corresponding to an equalizer) that has been experimentally derived so that the signal emitted by the loudspeakers on the occurrence of (known) external noise is detected, and that the best possible cancellation of the ambient noise is achieved, by the adjustment of the amplification level of the ANC microphone. This setting of the microphone thus obtained is then used for the lifespan of the resulting headphones.

Despite its simplicity, This method of calibration has some shortcomings, specifically in that no deviations in the characteristics of the test listener are taken into account. A definitive (and permanent) setting of microphone level fails to address the inevitable changes that may occur over the course of the lifetime of a pair of headphones, such as changes in the quality of the shielding provided by the headphone shells or their cushions, or electronic drift in any of the headphone electronics (amplifiers, loudspeakers, or microphones) due to the aging of their requisite mobile membranes.

CN 111800694 A discloses a method for calibrating active noise-cancelling headphones in which the headphones are placed on a measuring device and the active noise-cancelling circuit is excited. A corresponding cancellation filter function is then calculated in the frequency domain. The US 2011/222696 publication discloses a similar procedure for fitting active noise-cancellation headphones in the frequency domain. The disadvantage of these methods is that this type of signal processing is not suitable for all calibration applications, and can require an increased computational effort.

US 2019/080682 A1 discloses a more distant state of the art, as rather than determining parameters for the configuration of the active noise-cancelling headphones, or calculating an appropriate filter, the publication describes an apparatus for testing a headphone, and performing the required measurements.

Current tuning or calibration of ANC headphones is typically performed by measuring the impulse responses of prototype headphones and determining "average" (optimized) filter characteristics, which are programmed accordingly on the signal processors of the headphones (typically an integrated circuit including the ANC processor). These filter characteristics are then used in all headphones in that particular headphone series. In the course of manufacturing the actual products, the real impulse response is measured item by item and the amplification of the ANC microphone is optimally adapted to the difference between the measurement results and the desired final result.

What is needed, however, is a method of ANC headphone calibration that is capable of taking into account deviations and differences from the desired response for each headphone, and thereby maximizes the noise-cancelling characteristics of each individual headphone.

SUMMARY

The disclosure is directed to methods of calibrating active noise-cancelling (ANC) headphones, where during the development and manufacture of the headphone desired transmission pathways are determined, the transmission pathways of the ANC headphones produced are measured, and from these measurements complementary filter functions are determined using the Prony method (recursive), and the resulting filter function is implemented by the ANC headphones signal processor so that the headphones have the desired (ideal) transmission pathway, and the filter coefficients and/or amplification factors determined in this way are stored or activated on the signal processor.

The disclosed methods may include methods of calibrating an active noise-cancelling headphone, where the active-noise-cancelling headphone includes at least one signal processor on which at least one active noise-cancelling filter and its parameters are stored. Such methods may include placing the active noise-cancelling headphones on a measuring device; exciting the active noise-cancelling filter; measuring one or more relevant transmission pathways selected from x(n), m(n), and p(n) for feedforward and/or h(n) for feedback; defining at least one goal function for feedforward or feedback; calculating a complementary function for the at least one defined goal function for at least one branch of the at least one active noise-cancelling filter; calculating at least one impulse response of the complementary function from the measurements of the relevant transmission pathways; approximating one or more operating parameters for the active noise-cancelling filter using the Prony method, such that when they are implemented the active noise-cancelling filter will apply an approximated complementary filter corresponding to the calculated complementary function; and implementing the approximated operating parameters in the active noise-cancelling filter on the signal processor in order to create an approximated complementary active noise-cancelling filter, thereby calibrating the active noise-cancelling headphones.

DETAILED DESCRIPTION

Figure 1:
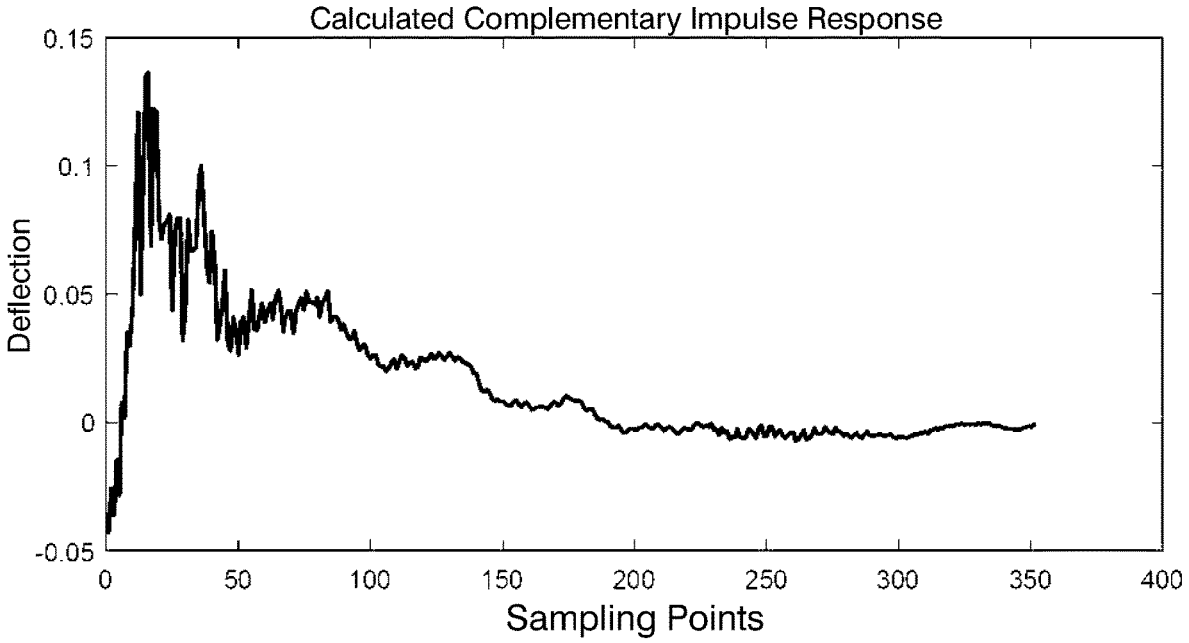
FIG. 1 is a plot showing a calculated complementary impulse response calculated according to the method of the present disclosure.
Figure 2:
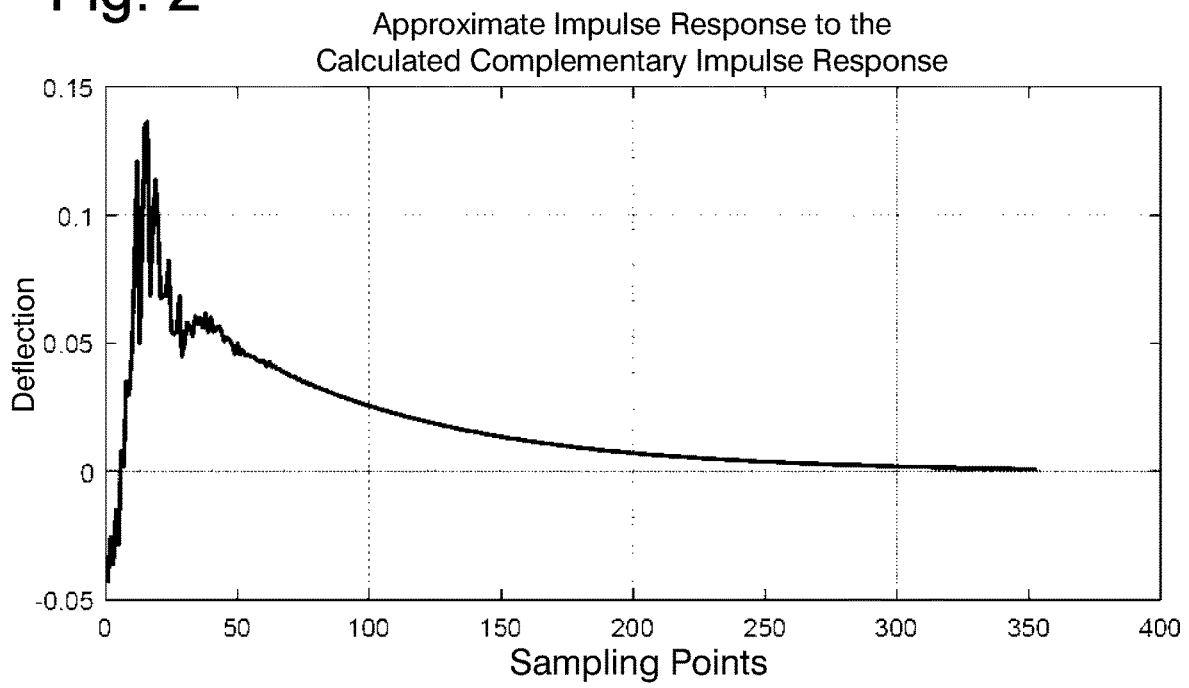
FIG. 2 is a plot showing an impulse response to the calculated complementary impulse response of FIG. 1.
Figure 3:
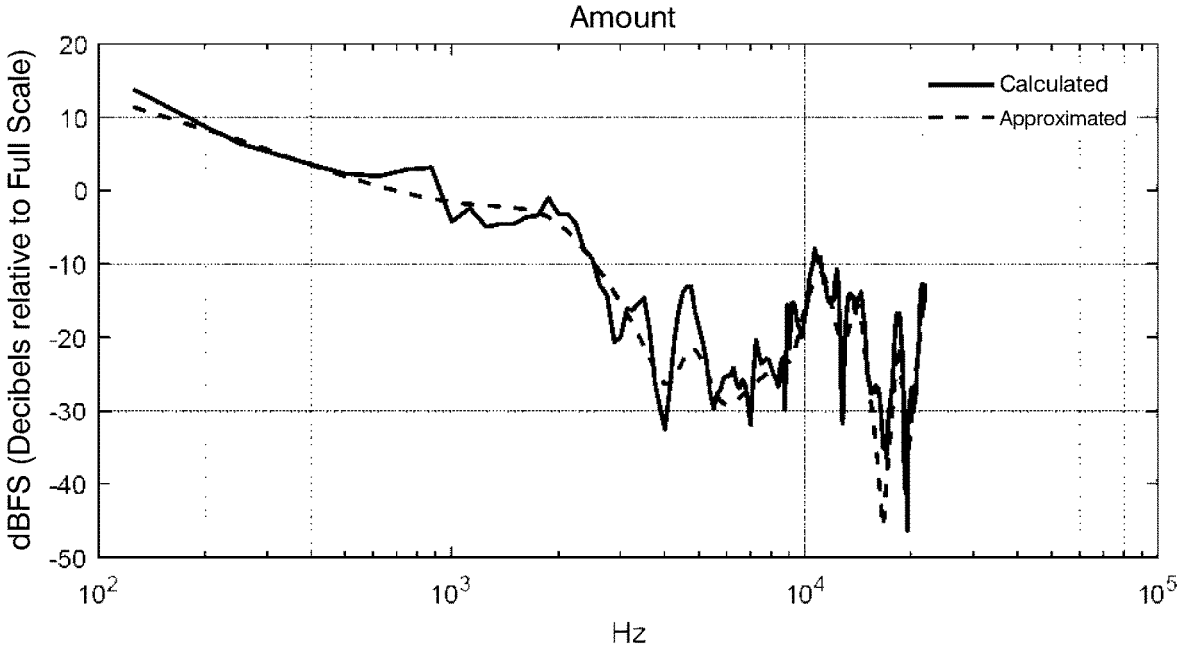
FIG. 3 is a plot comparing the calculated and approximate impulse responses of FIGS. 1 and 2.
Figure 4:
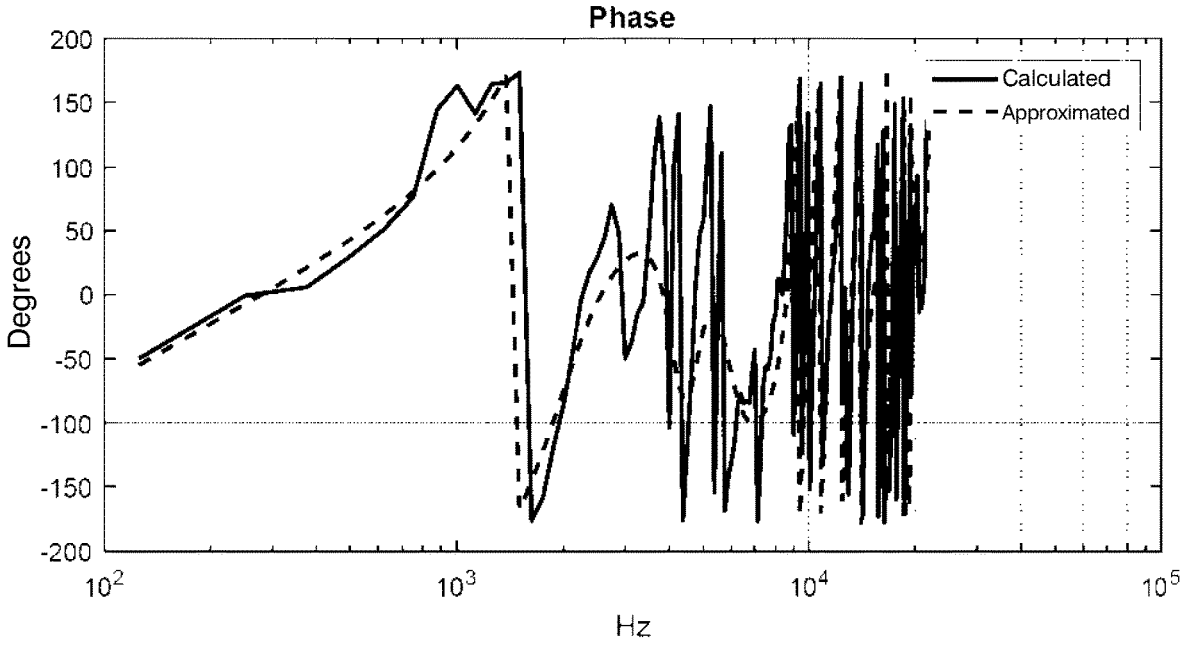
FIG. 4 is a plot showing phase as a function of frequency for the calculated and approximate impulse responses of FIGS. 1 and 2.

As used in the present specification, including the claims, a reference to headphone or headphones should be understood to include without limitation any headphone or earphone, including so-called in-ear earphones, earbud earphones, on-ear earphones, circumaural-ear earphones, among others, as well as hearing aids of all types.

In more detail, the disclosed method may be useful for calibrating or adapting an ANC headphone, where the ANC headphone includes at least one signal processor on which at least one ANC filter, in particular an infinite impulse response (IIR) filter, is stored. Also stored on the signal processor are any necessary operating parameters for the operation of the ANC filter.

The disclosed method may include the following steps:

a) Putting the headphones on a suitable measuring device (for example an acoustic coupler, an artificial head with measuring microphones, or a real head with probe microphones) that includes an analog or digital processor capable of data transmission, b) Measuring of the relevant transmission pathways while stimulating the ANC system (i.e., the ANC circuit) of the headphones, for example by chirping or some other noise, c) Defining at least one objective function to calculate a complementary function of at least one branch of the ANC application (of the ANC circuit), d) Calculating at least one impulse response of the complementary function(s) from the measurements of the relevant transmission pathways, e) Approximating one or more operating parameters for the active noise-cancelling filter using the Prony method, such that when they are implemented the active noise-cancelling filter will apply an approximated complementary filter corresponding to the calculated complementary function; and f) Entering or activating the calculated parameters in the signal processor of the ANC headphone.

Advantageously, the disclosed methods permit the measurement and calibration of individual ANC headphones. Generally speaking, the presently disclosed method involves the measurement of the performance of a finished ANC headphone product, followed by the filter characteristics of that ANC headphone product being changed in order to adapt the filter and optimize the filter's performance for that individual ANC headphone product. This measurement and tailored optimization is facilitated by the structure of the signal processor employed in such ANC headphones.

The signal processor of the ANC headphones is typically configured to employ a data transmission system, whether it is a BLUETOOTH wireless connection, another suitable wireless connection option, or the signal processor is accessible over a galvanic interface such as USB, or the like. As the measurement results for a given ANC headphone are made available digitally, and may be processed digitally (although this is not required), it is straightforward to adapt the digital filter coefficients for a given signal processor using one of the data transmission options that is available.

Furthermore, such an adjustment can be made to an ANC headphone product using the disclosed method over the product lifetime, even years later, if an appropriate measuring station is available, in order to compensate for changes in the acoustic behavior of the ANC headphone resulting from either use or age. In one aspect of the disclosed method, an initial active noise-cancelling filter for an ANC headphone is implemented based upon an initial (or previous) test, and the method further comprises additionally calibrating the active noise-cancelling headphones by repeating the presently disclosed method one or more additional times over the lifetime of the active noise-cancelling headphones.

In one aspect of the disclosed methods, the filter properties of the ANC headphone may be customized to result in the most complete possible reduction in external noise for the user. In another aspect of the disclosed methods, the customization of the filter properties of the ANC headphone may additionally take into account the stability of the ANC circle, in order to avoid various types of overloading and clinking. The use of feedback may be more sensitive than feedforward in maintaining this stability, as feedback systems typically operate with a closed control loop and must meet minimum stability criteria (e.g., amplitude <0 dB at phase 360 degrees; range: +/−180) in order to avoid "howling" or oversteering in the event of instability.

In one configuration of the disclosed method, the transfer functions determined in this way may be broken down into second-order polynomials, which makes it possible to employ the use of biquadratic cascades, which are frequently used in signal processors.

The disclosed methods are explained in greater detail below, with reference to the drawings:

FIGS. 1-4 show the graph of an approximation of an impulse response (complementary function) calculated according to the disclosed method from measured transmission pathways and a target function, using the Prony method.

Figure 5:
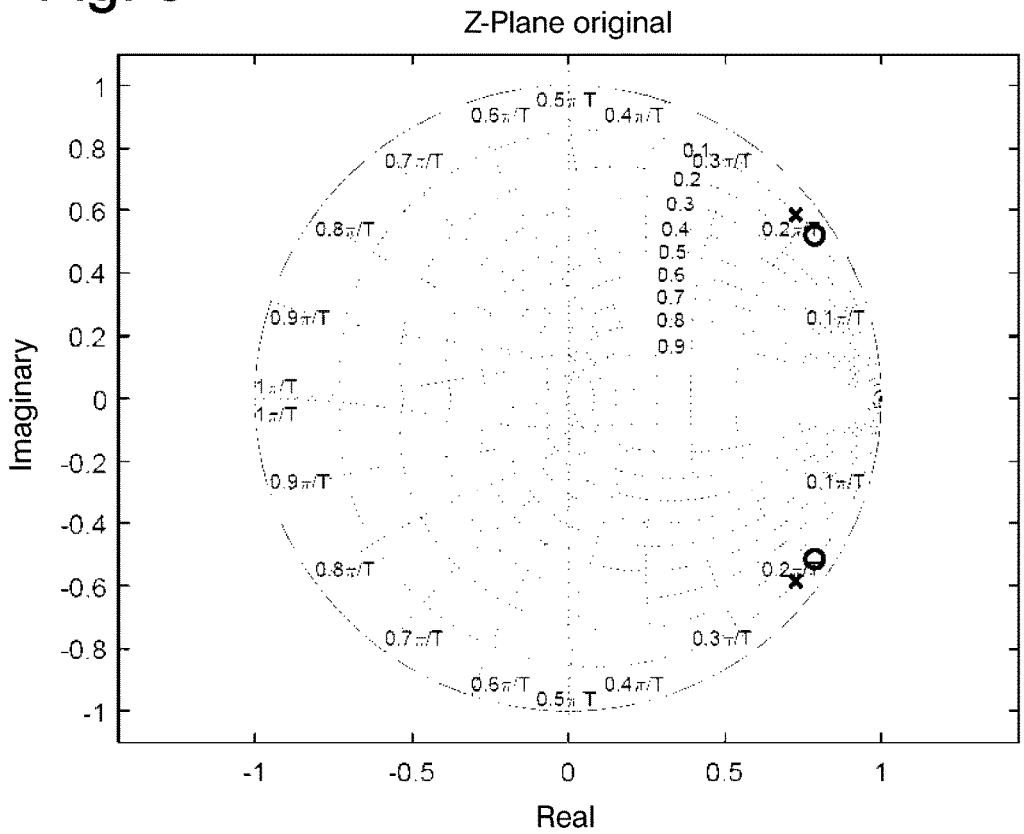
FIG. 5 is a complex plot of the poles and zero points for an IIR filter of 48 kHz.
Figure 6:
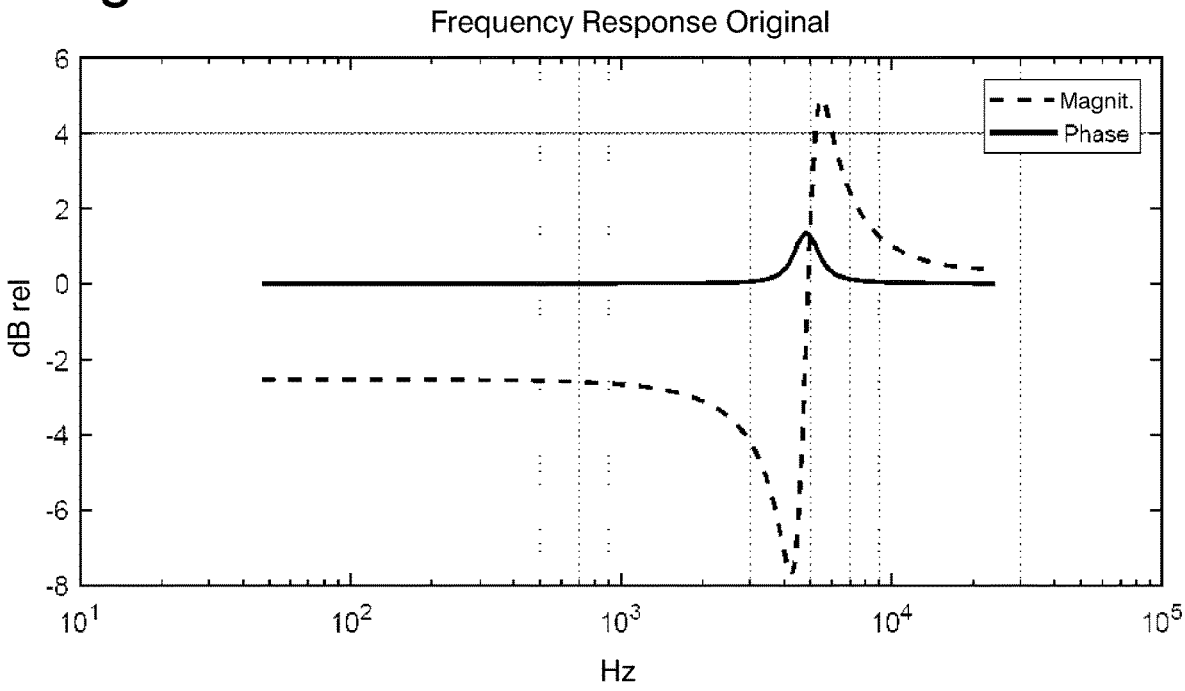
FIG. 6 is a plot of the magnitude and phase response for the IIR filter of FIG. 5.
Figure 7:
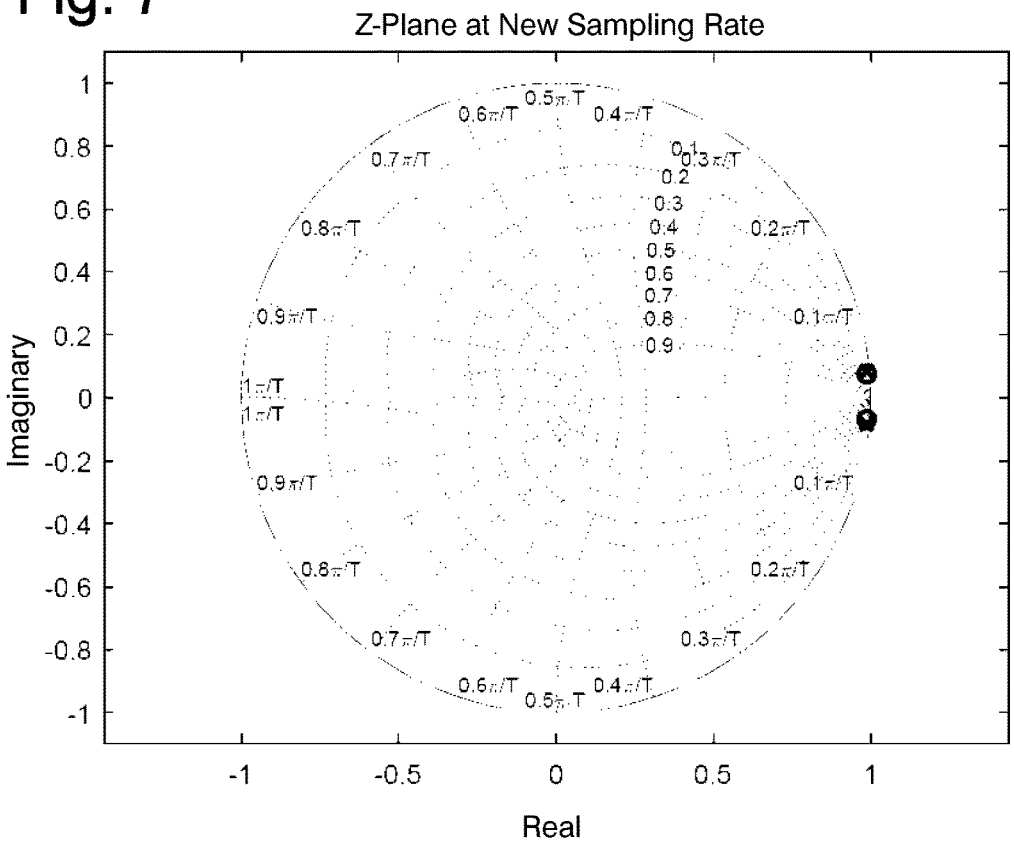
FIG. 7 is a complex plot of the poles and zero points for the IIR filter of FIG. 5 redeployed for 384 kHz.
Figure 8:
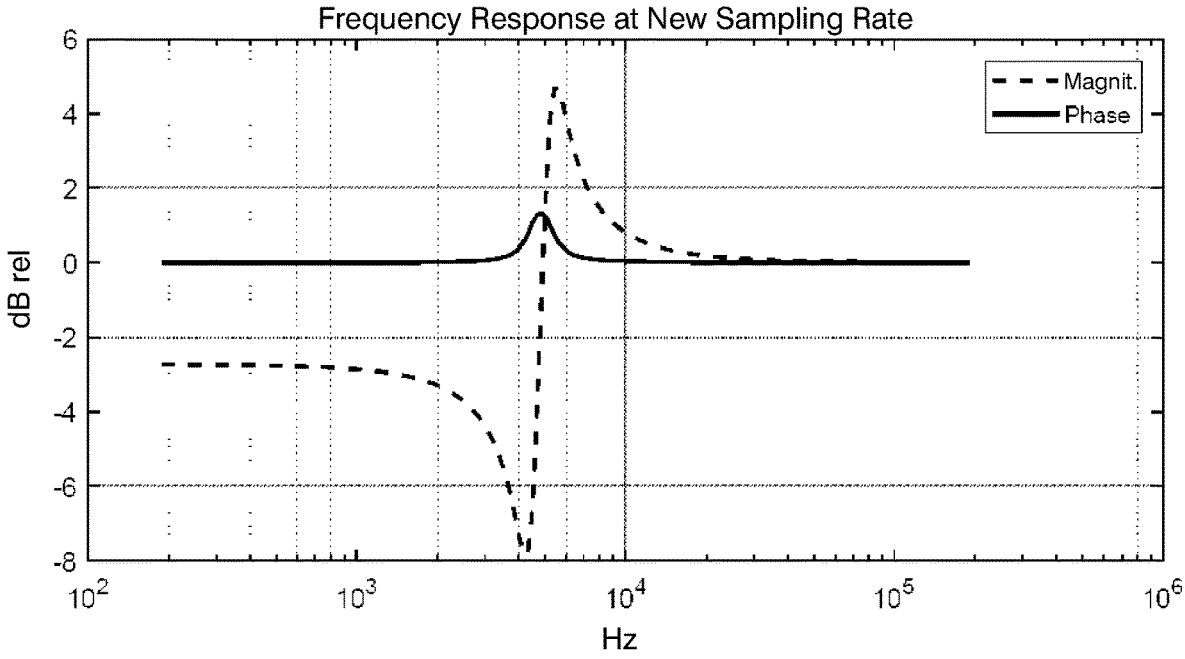
FIG. 8 is a plot of the magnitude and phase response for the IIR filter of FIG. 7.

FIGS. 5-6 shows an example of an IIR filter with a sampling rate of 48 kHz, while FIGS. 7-8 show the filter redeployed for a sampling rate of 384 kHz. FIGS. 5 and 7 display the poles and zero points of each filter as plotted in the complex plane, while FIGS. 6 and 8 indicate the magnitude (in dashed) and the phase response (solid).

Figure 9:
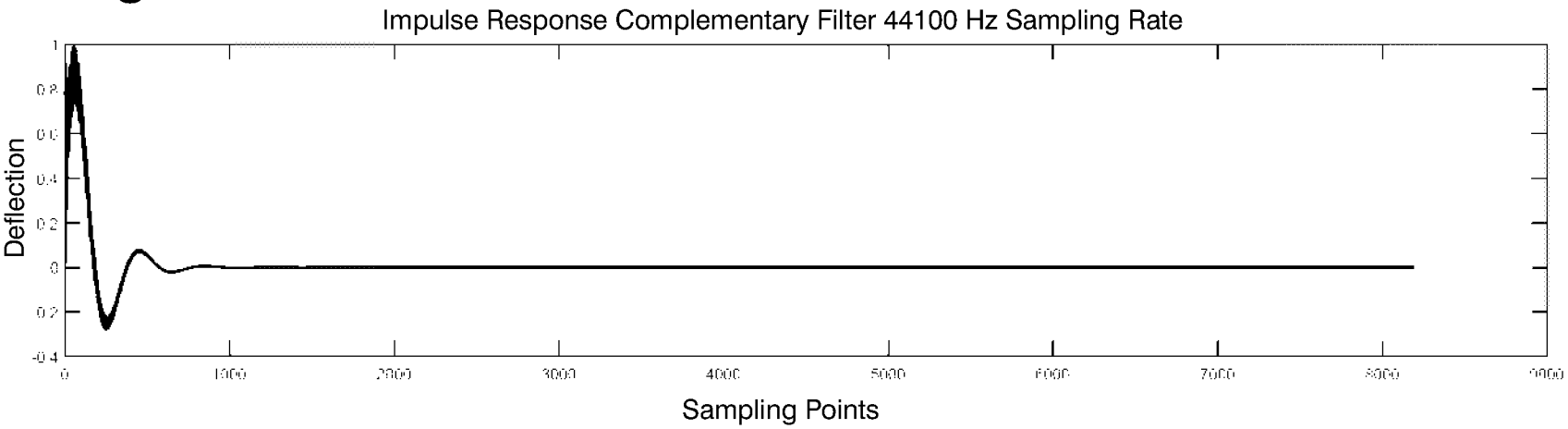
FIG. 9 is a plot of the impulse response of the complementary filter function approximated with biquadratic filters (IIR) at a sampling rate of 44100 Hz.
Figure 10:
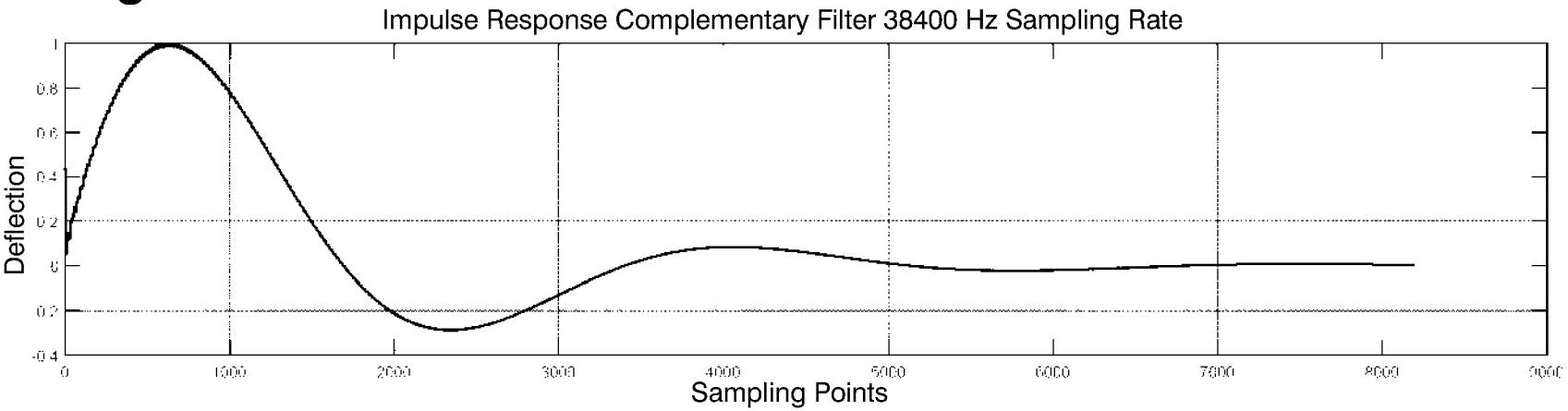
FIG. 10 is a plot of the impulse response of the complementary filter function approximated with biquadratic filters (IIR) at a sampling rate of 38400 Hz.
Figure 11:
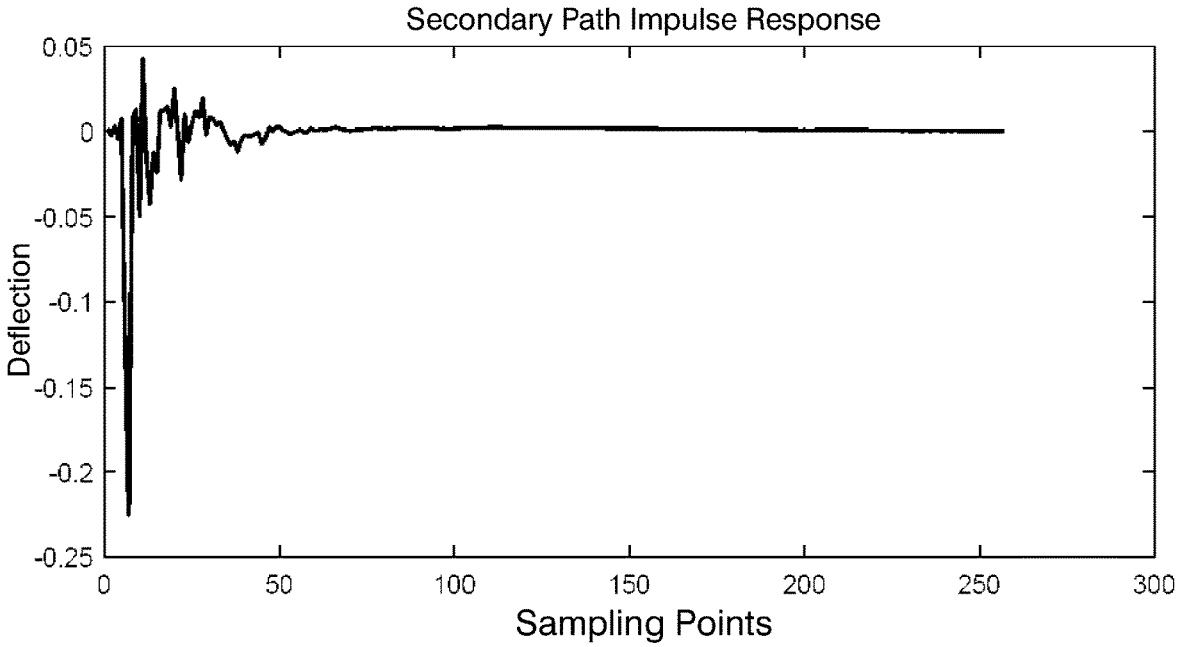
FIG. 11 is a plot showing the function of a feedback system with h(n), or the secondary pathway impulse response.
Figure 12:
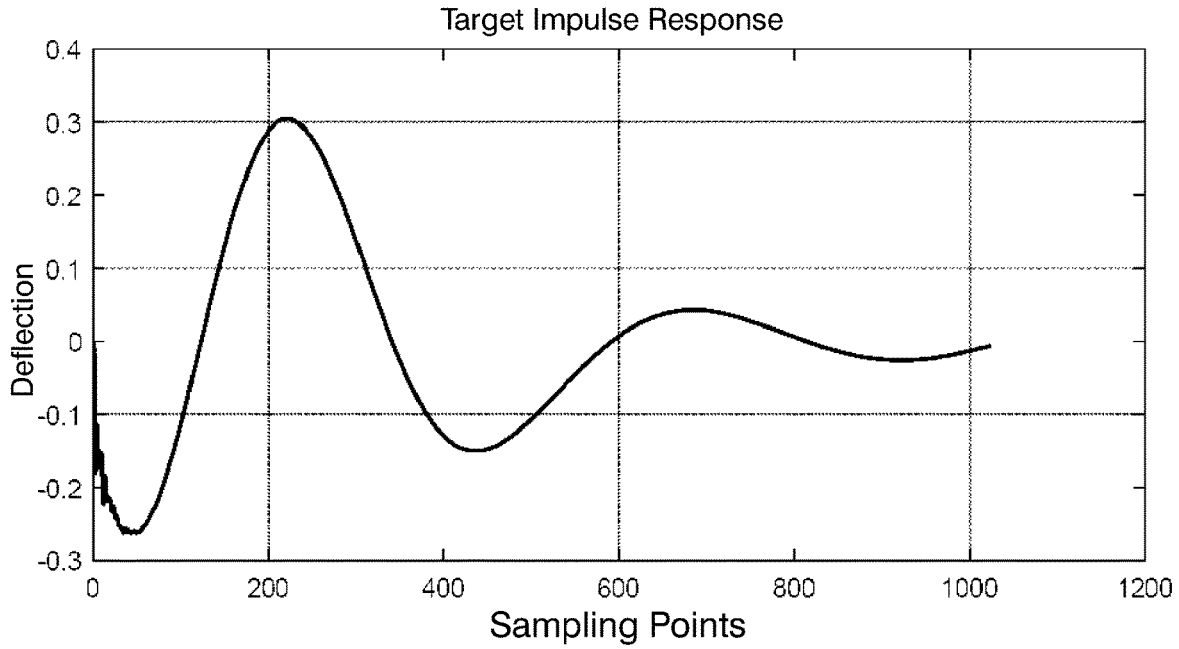
FIG. 12 is a plot showing the function of a feedback system with t(n), or the target impulse response.
Figure 13:
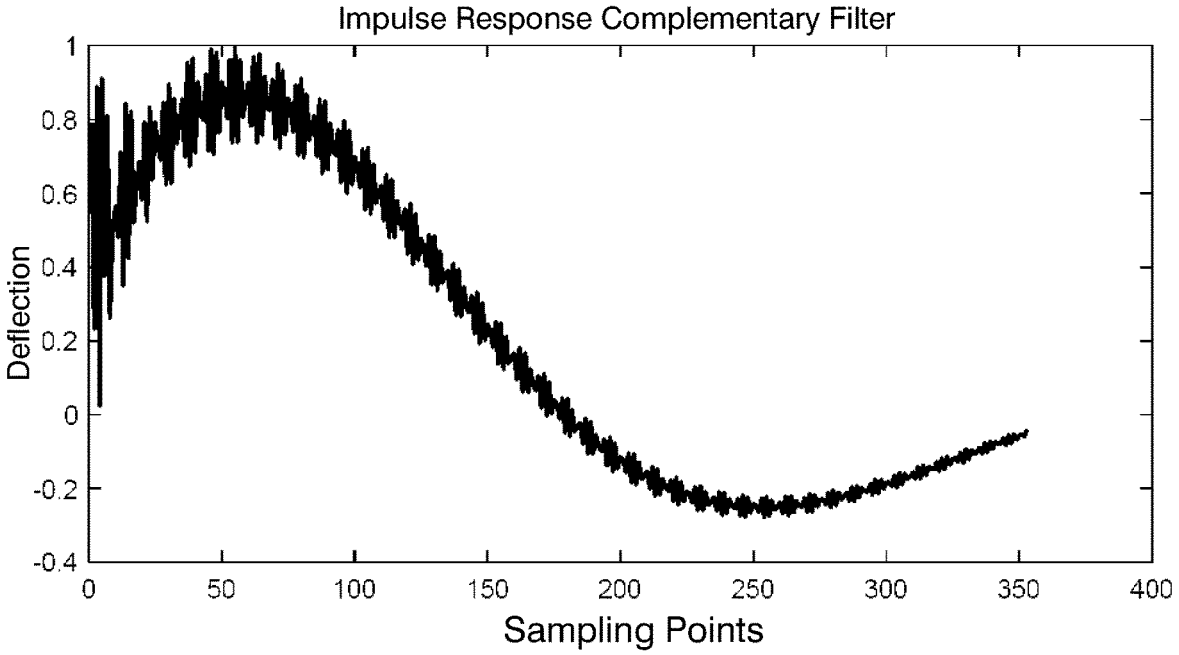
FIG. 13 is a plot of the complementary filter impulse response obtained and approximated by deconvolution.

FIGS. 9 and 10 show the result of the sampling rate adaptation of the impulse response using the example of the complementary filter function approximated with biquadratic filters (IIR).

Figure 14:
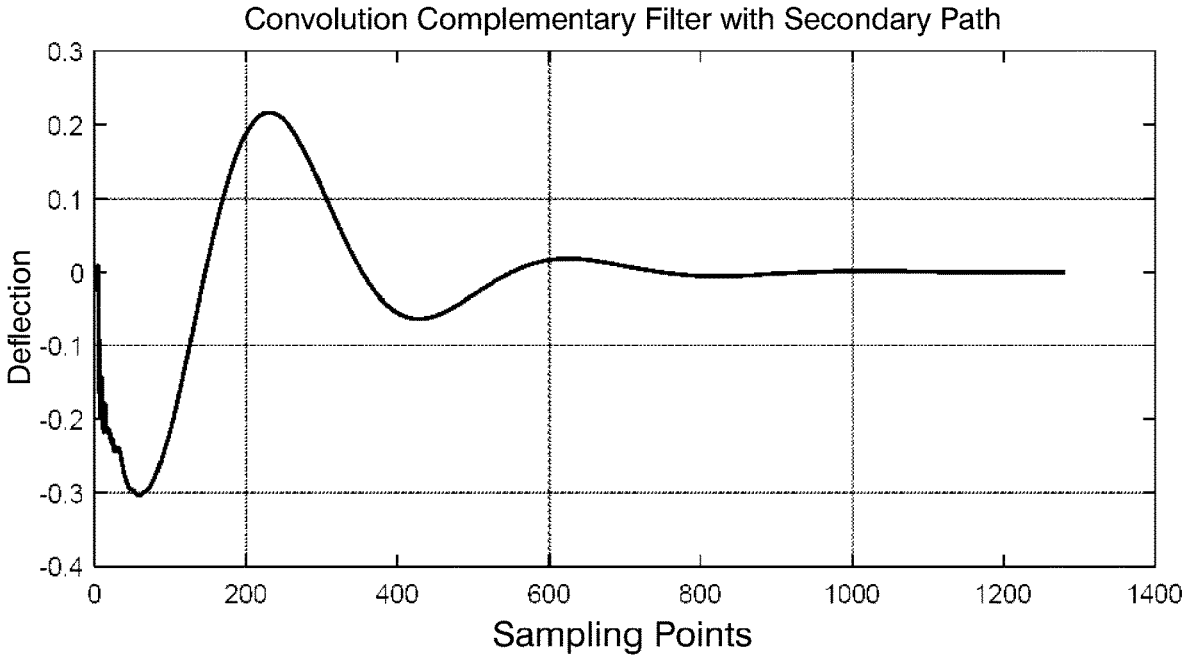
FIG. 14 is a plot of the convolution complementary filter response resulting from convolution of the secondary pathway and approximated complementary filter impulse response.

FIGS. 11-14 show the individual functions of a feedback system with h(n) (FIG. 11), t(n) (FIG. 12), and the complementary filter impulse response obtained and approximated by deconvolution (FIG. 13), while FIG. 14 shows the result of the convolution of the secondary pathway and approximated complementary filter impulse response to control the successful synthesis of the goal function.

An example of the method according to the present disclosure, and in particular the optimization procedure used therein, is described below. In this example, the method uses IIR (infinite impulse response) filters, since these require significantly less computing power and memory than FIR (finite impulse response) filters for the same result. In addition, some integrated circuits may only allow IIR filters, so the disclosed method can be used universally, regardless of whether the method employs a feedforward, a feedback or a hybrid system.

As discussed above, a measuring device determines the impulse responses of the transmission pathways (feedforward and feedback). The measuring device may include one or more acoustic couplers and a processor with a capacity for data transmission. In some aspects of the present methods, a data processor that can process a signal coupled with a data transmission capability may be required as an integral part of the measuring device, along with the acoustic coupler(s).

While installed upon the measuring device, the active noise-cancelling filter of the ANC headphone is excited. The filter can be excited using any conventional method, for example by using an audible chirp, or other noise, without limitation. The known characteristics of the microphones and the driver, which are available, should also be considered and added to the determined impulse responses of the passive pathways (by means of convolution). The impulse response of the feedforward pathway is thus given by:

$$x(n)*m(n)*f(n)=-p(n)$$

where x(n) corresponds to the transmission pathway from the loudspeaker of the ANC headphones to the cancellation point of the feedforward ANC system (acoustic coupler, artificial head microphone, real head with probe microphone, etc.) and m(n) corresponds to the transmission pathway between the external loudspeaker (noise source) and the feedforward microphone. In a feedforward system, the objective function p(n) corresponds to the passive transmission pathway to the cancellation point. Analogously to the feedback system, the desired complementary function f(n) can be calculated by deconvolution from the three available paths x(n), m(n) and p(n) and then approximated using the method according to the present disclosure. As is customary in the field of active noise cancellation, the cancellation point for the feedforward ANC circle describes the point at which the counter wave generated by the ANC system cancels the sound wave penetrating the headphones from outside the headphones.

The feedback pathway is determined by deconvolution of a target impulse response t(n):

$$h(n)*i(n)=t(n)$$

The measured real impulse response h(n), which is also referred to as the secondary pathway (corresponding to the transmission pathway between ANC headphones, loudspeaker and feedback microphone), convoluted with the calculated impulse response i(n) results in the objective function t(n). The impulse responses for feedforward and feedback are thus given. The individual functions and the resulting already approximated complementary filter impulse response are shown in FIGS. 5-8.

A given impulse response can be considered as an FIR filter of the length of the impulse response, with the values of the individual samples acting as filter coefficients. The transfer function thus has the form $$H(z)=\sum_{i=0}^{M} b_i z^{-i}$$

An IIR filter, on the other hand, has the form $$H(z)=\frac{\sum_{i=0}^{M} b_i z^{-i}}{\sum_{i=0}^{N} a_i z^{-i}}$$

Due to hardware limitations, a given integrated circuit may not necessarily have the option of using an FIR filter for ANC (such filters require too many taps). With an IIR filter it is, however, possible because the feedback structure requires fewer taps. It is therefore advantageous to approximate the given impulse response using an IIR polynomial.

There are various ways of doing this: In one implementation, the Prony method, as shown in FIGS. 1-4, is used. The Prony method approximates the given impulse response by means of exponentially damped cosine oscillations. The advantage of using the Prony method is that the result is an IIR polynomial, in contrast to the filter approximation in the frequency range where the result is FIR filters, which then require further methods to generate IIR polynomials. The Prony method approximates impulse responses; that means work has to be done in the time range. Impulse responses as transmission pathways are already given via the measurement, whereby the need not to fall outside the time range is also obvious. The approximation of the ANC filter in step e) of the method sequence above corresponds to the conversion of the ideal FIR impulse response of the filter into an IIR filter function using the Prony method.

$$\hat{f}(T)=\sum_{i=1}^{M} A_i e^{\sigma_i t}\cos(\omega_i t+\phi_i)$$

Due to this approximation, the determined transfer function has more coefficients than required: ANC filters are usually defined up to 2 kHz, as a good passive attenuation can be expected above this. Optionally, the order of the transfer function can be reduced.

Impulse responses are typically recorded at a lower sampling rate than that used in the ANC system. Sampling rates of 44.1 or 48 kHz are common, while an ANC system is more likely to be clocked at sampling rates of 192 or 384 kHz. The determined IIR filter must therefore be scaled from 48 kHz to 384 kHz, for example, whereby the frequency response in absolute terms (in Hz) should remain the same (in a relevant range).

The scaling of an IIR filter is not obvious because the transfer function has to change. The method proposed here uses poles and zero points of the transfer function H(z). The unit circle on the z-plane describes the frequency response (which can also be determined using the Fourier transformation):

$$z=e^{j\omega}$$

The DC component (0 Hz) can be found at the (Cartesian) coordinate 1+0j, while half the sampling frequency can be found at −1+0j (Nyquist frequency). For 48 kHz the Nyquist frequency is 24 kHz. In radians it is π, i.e. half the unit circle. For the higher sampling rate (384 kHz), π is 192 kHz. This means that there is more bandwidth (in Hz) in the same range in radians.

If a straight line is drawn from the point of origin (0+0j) through a pole (or a zero point) up to the unit circle, its angle (based on the abscissa) for the low sampling rate can be seen first. The point on the unit circle corresponds to a frequency f in Hz.

$$f = \frac{\varphi}{\pi}\frac{f_s}{2} \text{ in Hz}$$

The point on the unit circle in Hz can be converted into corresponding radians for the increased sampling rate.

$$\varphi_u = \frac{f}{0.5 f_{su}}\pi$$

This means that the angle by which the poles and zero points must be rotated is known in order to scale the transfer function for the higher sampling rate. In addition, the damping factors must be adjusted. The lines of constant attenuation of the s-plane are transformed into a spiral-shaped root locus on the z-plane through corresponding mapping (bilinear transformation, momentum invariance, etc.). From the origin point of a pole or a zero point, the location-root function to the DC point must be determined. The new position of a pole/zero point is at the intersection between the location-root function and the new angle for the higher sampling rate. The result of this adjustment is depicted in FIGS. 7 and 8.

Special regulations of the procedure are necessary for poles/zero points which are at the Nyquist frequency for the low sampling rate: Since these migrate for the higher sampling rate (from π to <π), these poles/zero points must also migrate and be mirrored along the abscissa in order to obtain a real-valued filter. In the course of this process, more zeros than poles can arise, which leads to a transfer function that is not well-defined. Poles close to the point of origin are to be added so that their influence is small, but the transfer function is well defined. It is known that a polynomial with more coefficients in the numerator than in the denominator is not well defined because it would be anti-causal.

After scaling the transfer function, according to FIGS. 9 and 10, it has to be broken down into functions of the 2nd order (biquadratic cascade), as these can typically be implemented in ICs and are also more stable. Optionally, the scaling can be done after the breakdown into biquadratic filters. The decomposition can be done by means of partial fraction breakdown.

The coefficients obtained in this way for biquadratic, thus recursive, filters can be converted into a difference equation and used in a suitable integrated circuit. However, as most ANC integrated circuits include the ability to enter filter coefficients directly via their programming interface and/or development environment, the filter coefficients for IIR but sometimes also FIR filters can be entered directly and implemented without any problems.

For example, in the signal processor of a feedback ANC system, the feedback filter is programmed with the coefficients of the calculated complementary function approximated according to the above description. This programming is usually done via the development environment of the respective signal processors (ANC ICs) or by importing firmware provided with the coefficients using the methods already explained.

The invention can be modified and changed in various ways, so the measuring means can have or consist of any other arrangement of microphones in addition to the aforementioned possibilities of an artificial head, etc., while only the required data, familiar to the specialist with knowledge of the invention, are recorded.

Whether an existing filter is configured in the signal processor at the beginning of the process, or a filter is present due to having already been adapted based on experience, ultimately does not matter, as running through the steps of the disclosed method again from step b), possibly with further repetitions, will quickly lead to the creation of an optimal filter configuration.

Since the characteristics of ANC headphones may change during their life cycle, and their relevant transmission pathways can change as a result, a periodic recalibration can be useful. The omission of step a) of the disclosed method from this repetition of the method is due to the fact that the repetition can also take place immediately after the first adjustment, while the headphones are still mounted on the measuring device.

This may be particularly noticeable during the final adjustment of a whole series of headphones for which their initial configuration can be assumed to have been obtained by means of the first headphones configured according to the present method.

Alternatively, or in addition, adjustments to ANC headphones that have already been in use, potentially for extended periods, are also readily possible without any problems.

Additional aspects of the disclosed methods can include, for example, that in step b) of the method the transmission pathways are measured digitally at the sampling rate of the measuring system, that the ANC headphones have a clock rate provided by the digital signal processor, that the clock rate is higher than the sampling rate and that the approximated complementary filter(s) are scaled in the ratio of the sampling rate to the clock rate, so that the frequency response of the approximated complementary filter(s) remains the same in absolute terms, in Hertz. The scaling of already approximated ANC filters according to the ratio between the clock rate of the working signal processor in the ANC listener and the sampling rate of the measuring system means, in other words, that the coefficients of the IIR filter function are changed numerically in order to generate an identical frequency response at the higher clock rate of the signal processor.

In another aspect of the disclosed methods, the step of approximating one or more operating parameters for the active noise-cancelling filter results in an approximated complementary filter having a higher order polynomial higher than the signal processor of the ANC headphone can process in real time. In such cases, the method may further include reducing the order of the polynomial in order to match the performance characteristics of the signal processor.

The need to reduce the order of the approximated complementary filter arises from the fact that the signal processing in the headphones must occur in real time during operation, since active noise cancellation is only useful for real-time applications. Digital signal processors (DSP) may have various hardware-related properties known to those skilled in the art that may represent restrictions that must be observed when using them (e.g. arithmetic operations/cycle, clock rates inherent in the processor, energy requirements, etc.). As a result there may be many reasons for, or restrictions resulting in, signal processing processes (e.g. filters) that cannot be carried out in real time, with the list therefore not to be regarded as conclusive. The utilization of these signal processors can of course depend on the pure generation of an ANC signal as well as on other factors, such as the processing of the audio signal to be output (e.g. music) or BLUETOOTH streaming. However, this is not an imperative. For example, it would be possible to install several signal processors in one headphone, each of which has its own task. The disadvantage of this is obvious and can be found in higher costs and greater space consumption and/or energy requirements. Since headphones have traditionally had to make do with a limited amount of space in their housing, it is advantageous, but not absolutely necessary, to assign several tasks to a given signal processor. Due to this possibility of adapting the system resources on the basis of the allocation of several tasks to a signal processor, it may therefore be necessary to adapt the order of the approximated complementary filter (s) to the signal processor (s).

As an example, an IIR—polynomial or IIR cascade 2nd order are already filter implementations. However, if the ANC signal processor does not have enough power to, for example, execute a cascade of 16 second-order filters, then the order may be reduced. In this example, the order may be reduced to 8 second-order filters. Such a reduction should be performed in such a way that the ANC performance is not significantly impaired. However this is neither trivial nor obvious, as even the slightest deviation from the ideal may lead to strong negative effects on noise suppression, as is well-known in the field of active noise cancellation.

As digital signal processors implementing ANC applications must operate in real time in order to make sound suppression possible at all, they necessarily operate at much higher clock rates (e.g. a maximum of 768 kHz, typically 384 kHz) than more typical acoustic measurement systems (typically 48 kHz). Routine conversion of filters for a higher sampling rate is possible with known design methods and is known to the person skilled in the art. The presently disclosed method, however, employs a filter cascade that does not follow a known design method (as explained in the text by approximating the impulse response using the Prony method), so the scaling of the filters by routine means is no longer feasible. The pole/zero positions of the IIR filter polynomials, which are calculated based on the transmission lines sampled at 48 kHz, for example, must not shift in their position with respect to the natural frequency of the filter during upsampling, as otherwise the filter characteristics will no longer match the required complementary function. However, the poles and zeros on the z-plane must be changed to match the higher sampling rate of the ANC system; so that the characteristics of the filter cascade are retained with regard to their natural frequency.

Additional and different problems may also arise: Handling of special cases such as poles/zeros on the real axis (0 or Pi) which also have to be shifted at 0 rad/s in order to maintain the characteristic. Furthermore with Pi rad/s: Here the poles/zeros are moved away from the axis and must be mirrored in order to maintain a real-valued filter. All of these effects has an influence on the magnitude and phase response of the filter cascade and must be compensated accordingly. For this reason, this clock rate adjustment can be decisive for the quality of the ANC.

The described determination of whether a reduction in complexity is required may be made by the operating specialist or via a corresponding algorithm after the measurement step of the presently disclosed method. This decision does not have to be made in real time, since the storage of the polynomial is not time-sensitive, as the adjustment may be made at any time before the headphones are sold. In this way it can be guaranteed that the ANC system can perform optimally in real time in the future.

The following numbered paragraphs describe selected additional aspects and features of the methods of the present disclosure. Each of these paragraphs can be combined with one or more other paragraphs, and/or with disclosure from elsewhere in this application, including materials incorporated by reference, in any suitable manner. Some of the paragraphs below expressly refer to and further limit other paragraphs, providing without limitation examples of some such suitable combinations.

A1. Procedure for calibrating or adapting ANC headphones that have at least one signal processor on which at least one ANC Filter, in particular an IIR filter, and the parameters of which are stored, comprising the following steps:

a) placing the headphones on a measuring device, for example a coupler, an artificial head with measuring microphones, or a real head with probe microphones, containing an EDP with data transmission;

b) measuring the relevant transmission routes x(n), m(n) and p(n) for feedforward or for feedback, upon excitation of an ANC circuit of the headphones, for example by chirping or noise, characterized in that it comprises the following steps:

c) defining at least one goal function (−p(n) for feedforward or t(n) for feedback) to calculate a complementary function (f(n) for feedforward or i(n) for feedback), at least one branch of the ANC circuit (feedforward or feedback) of the headphones;

d) Calculating at least one impulse response of the complementary function(s) (f(n) for feedforward and/or i(n) for feedback) from the measurements of the relevant transmission pathways;

e) approximating the parameters of the ANC filter(s) that are necessary to achieve the complementary function(s) using the Prony method;

f) entering or activating the calculated parameters in the signal processor.

A2. The procedure according to paragraph A1, characterized in that in step b) the transmission pathways are measured digitally with a sampling rate of the measuring system, that the ANC headphones have a digital signal processor which has a given clock rate, that the clock rate is higher than the sampling rate, and that the already approximated ANC filter(s) are scaled in the ratio of the sampling rate to the clock rate, with the frequency response of (an) approximated complementary filter(s) remaining the same in absolute terms, in Hertz.

A3. The procedure according to paragraph A1 or A2, characterized in that in step e) the order of a polynomial of the approximated complementary filter(s) is/are higher than the signal processor(s) can process in real time and that the order of the approximated complementary filter(s) is reduced to match the performance of the signal processor(s).

A4. The procedure according to one of the preceding paragraphs, characterized in that it is repeated from step b) for control and/or more precise calibration.

A5. The procedure according to one of the preceding paragraphs, characterized in that the headphones are from a production series in which the original parameters of the ANC filter are entered or activated based on previous tests, which are then adjusted by repeating the method over the lifetime of the headphones.

Although the present invention has been shown and described with reference to the foregoing operational principles and preferred embodiments, it will be apparent to those skilled in the art that various changes in form and detail may be made without departing from the spirit and scope of the invention. The present invention is intended to embrace all such alternatives, modifications and variances that fall within the scope of the appended claims.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

What is claimed is:

1. A method of calibrating an active noise-cancelling headphone, where the active-noise-cancelling headphone includes at least one signal processor on which at least one active noise-cancelling filter and its parameters are stored, comprising:

a) placing the active noise-cancelling headphones on a measuring device;

b) exciting the active noise-cancelling filter;

c) measuring one or more relevant transmission pathways selected from x(n), m(n), and p(n) for feedforward and/or h(n) for feedback;

d) defining at least one goal function for feedforward or feedback;

e) calculating a complementary function for the defined at least one goal function for at least one branch of the at least one active noise-cancelling filter;

f) calculating at least one impulse response of the complementary function from the measurements of the relevant transmission pathways;

g) approximating one or more operating parameters for the active noise-cancelling filter using the Prony method, such that when the approximated operating parameters are implemented the active noise-cancelling filter will apply an approximated complementary filter corresponding to the calculated complementary function; and h) implementing the approximated operating parameters in the active noise-cancelling filter on the signal processor in order to create an approximated complementary active noise-cancelling filter, thereby calibrating the active noise-cancelling headphones.

2. The method of claim 1, wherein placing the active noise-cancelling headphones on a measuring device includes placing the active noise-cancelling headphones on a measuring device that includes one or more acoustic couplers.

3. The method of claim 2, wherein placing the active noise-cancelling headphones on a measuring device includes placing the active noise-cancelling headphones on a real or artificial head.

4. The method of claim 1, wherein placing the active noise-cancelling headphones on a measuring device includes placing the active noise-cancelling headphones on a measuring device that includes a data processor with a data transmission capability.

5. The method of claim 1, wherein defining at least one goal function for feedforward or feedback includes defining a goal function −p(n) for feedforward or a target impulse response function t(n) for feedback.

6. The method of claim 5, wherein calculating a complementary function for the defined at least one goal function includes calculating a complementary function f(n) for feedforward or i(n) for feedback.

7. The method of claim 1, wherein:

measuring the one or more relevant transmission pathways includes measuring the relevant transmission pathways with a digital measuring system having a sampling rate;

the at least one signal processor is a digital signal processor having a clock rate that is higher than the sampling rate of the digital measuring system; and the approximated complementary filter is scaled in a ratio of the sampling rate to the clock rate, such that a frequency response of the approximated complementary filter remains the same in absolute terms.

8. The method of claim 1, wherein if approximating the one or more operating parameters for the active noise-cancelling filter results in an order of a polynomial of the approximated complementary filter being higher than the signal processor can process in real time, then the method further comprises reducing the order of the polynomial to match a performance of the signal processor.

9. The method of claim 1, further comprising repeating steps b)-g) one or more additional times.

10. The method of claim 1, wherein the at least one initial active noise-cancelling filter was implemented based upon a previous test, further comprising additionally calibrating the active noise-cancelling headphones by repeating the method a plurality of times over a lifetime of the active noise-cancelling headphones.

* * * * *